US006050047A

United States Patent [19]

Covelli et al.

[11] Patent Number: 6,050,047

[45] Date of Patent: Apr. 18, 2000

[54] REINFORCED COMPOSITE WOODEN STRUCTURAL MEMBER AND ASSOCIATED METHOD

[75] Inventors: Fred M. Covelli, Murrysville; Theodore H. Dailey, Jr., Kittanning; Raymond L. Bender, Gibsonia, all of Pa.; Michael R. O'Halloran; Borjen Yeh, both of Gig Harbor, Wash.; Ronald W. Allison, Bedford; Joseph Hickman, Pittsburgh, both of Pa.

[73] Assignee: Borden Chemical, Inc., Columbus, Ohio

[21] Appl. No.: 08/932,396

[22] Filed: Sep. 17, 1997

Related U.S. Application Data

[63] Continuation of application No. 08/632,042, Apr. 12, 1996.

[51] Int. Cl.[7] ..... E04C 3/12

[52] U.S. Cl. ..... 52/730.7; 52/745.19; 52/309.3; 52/309.13; 52/309.14

[58] Field of Search ..... 52/309.3, 309.13, 52/309.14, 309.15, 309.16, 745.19, 720.1, 730.1, 730.7, 738.1; 428/114, 537.1

[56] References Cited

U.S. PATENT DOCUMENTS

| | | | |
|---|---|---|---|
| 2,847,733 | 8/1958 | Roy | 428/114 |
| 3,707,286 | 12/1972 | Spieth et al. | 52/730.7 X |
| 3,827,689 | 8/1974 | Hyde | 52/730.7 X |
| 4,195,462 | 4/1980 | Keller et al. | 52/730.7 X |
| 4,204,421 | 5/1980 | Rogers et al. | 428/114 X |
| 4,428,791 | 1/1984 | Reinke . | |
| 4,430,373 | 2/1984 | Hammarberg . | |
| 4,615,163 | 10/1986 | Curtis et al. . | |
| 4,965,973 | 10/1990 | Engebretsen . | |
| 5,026,593 | 6/1991 | O'Brien . | |
| 5,058,339 | 10/1991 | Krstovic . | |
| 5,362,545 | 11/1994 | Tingley . | |
| 5,456,781 | 10/1995 | Tingley . | |
| 5,497,595 | 3/1996 | Kalinin | 52/309.16 X |
| 5,791,047 | 8/1998 | Skalka | 52/309.16 X |

FOREIGN PATENT DOCUMENTS

| | | | |
|---|---|---|---|
| 1050836 | 1/1954 | France | 52/730.1 |
| 1447418 | 6/1966 | France | 52/730.1 |
| 2531656 | 2/1977 | Germany | 52/730.7 |
| 8701712 | 2/1989 | Netherlands | 52/720.1 |
| WO 86/02122 | 4/1986 | WIPO | 428/114 |

OTHER PUBLICATIONS

Dailey et al. United States Patent Application Serial No. 08/380,858 entitled "*Reinforced Composite Structural Member and Associated Method*," filed Jan. 30, 1995.

*Primary Examiner*—Carl D. Friedman
*Assistant Examiner*—Laura A. Callo
*Attorney, Agent, or Firm*—David W. Brownlee; Arnold B. Silverman; Eckert Seamans Cherin & Mellott, LLC

[57] ABSTRACT

A reinforced structural composite member includes a plurality of wood members with at least one recess in a first wood member facing another wood member and a generally rectangular fiber reinforcing composite member secured within the recess. The recesses are in the aggregate of lesser width than the wood members within which they are secured. In a preferred embodiment the aggregate width of the recesses is less than about 30 percent of the width of the wood member having the recesses. A suitable adhesive, which is preferably resorcinol or a phenol resorcinol-based adhesive, may be employed to secure the wood members to each other. The elongated fiber reinforcing composites may be adhesively secured within the recesses. Corresponding methods employing either preformed recesses or in situ formed recesses are provided.

27 Claims, 6 Drawing Sheets

REINFORCED COMPOSITE WOODEN STRUCTURAL MEMBER AND ASSOCIATED METHOD

CROSS-REFERENCE TO RELATED APPLICATION

This is a continuation of U.S. patent application Ser. No. 08/632,042, filed April 12, 1996.

BACKGROUND OF THE INVENTION

1. Field of the Invention

The present invention relates to a structural member created by assembling a plurality of wooden members with suitable reinforcing means disposed within recesses within the structural members so as to provide increased load bearing capacity for the structural member. The invention also provides a related method of creating such a structural member.

2. Description of the Prior Art

Engineered wood products, such as glued laminated (glulam) beams and columns, structural use panels, such as plywood and oriented strand board (OSB) and the like are in common use today as structural members. The use of composite structural members to increase strength to cost and strength to cross-sectional area ratios is known. Composite structural members are typically stronger and lighter and may be less expensive than similarly sized single material members. The use of wood/wood and wood/non-wood composites enables the use of lower grades of wood in applications where only high grade, high strength woods were utilized previously. As a result, the use of composite structural members encourages more efficient use of natural wood resources.

Prior uses of woven fabrics, such as fiberglass, and thermoplastic composites to reinforce wood members have been less than satisfactory. The difficulty of obtaining a strong adhesive bond between the plastic composite material and the wood has resulted in losing bond integrity under load and over time. The loss of integrity of such bond results in instability of the composite structural member. Another drawback of conventional fiberglass and thermoplastic composites is their susceptibility to fire and the tendency to generate smoke in fire conditions.

It has been known to enhance tensile strength of reinforced fiber composites by pre-stressing the composites with respect to a structural member. It also has been known to provide grooves on all sides of a building member and to mechanically or adhesively secure pre-stressed reinforcing members in such grooves. It has also been known to provide wooden members with grooves which receive adhesively secured, circular, triangular or bull-nosed glass fiber polyester rods for reinforcement. See U.S. Pat. No. 4,615,163.

U.S. Pat. No. 5,026,593 discloses providing a reinforcing strip across the entire width of a wood beam.

U.S. Pat. No. 4,965,973 discloses bonding pre-stressed reinforcing member to a wood beam in order to increase stiffness and bending strength. It has also been known to pre-stress a structure by applying tension to fibers relating to a wooden structural member prior to or during manufacture as by securing the fiber in tension to the wood by adhesion or by mechanical means.

U.S. Pat. No. 4,430,373 discloses the use of reinforcing threads positioned directly within particle board.

U.S. Pat. No. 4,428,791 discloses the use of threads or wires extending in the direction around bars which are positioned around a rotating drum and are secured to the fibers by a binding agent. Adhesive bonds a pair of strands to each other.

U.S. Pat. No. 5,058,339 discloses the use of flat metal bars as stringers inside a curved stairway.

Co-pending U.S. Ser. No. 08/380,858 entitled "Reinforced Composite Structural Member and Associated Method" owned by the assignee of the present application discloses the use of reinforced composite sheet having randomly oriented fiberglass fibers in a matrix of thermosetting resin.

There remains, therefore, a need for a composite structural member and associated method which employs wood members and associated specifically positioned fiber reinforced resin composite members to provide increased load bearing capacity including high bending strength and the reinforced wood assembly while preserving the dimensions and wooden appearance of the structural member.

SUMMARY OF THE INVENTION

The present invention has met the above described need by providing a plurality of wood members at least one of which has at least one recess facing another said wood member with fiber reinforcing composite members disposed within the recesses and the fiber reinforced composite member being of lesser width and length than the wood member such that the reinforcement is not visible from the exterior of the structural member or, in the alternative, generally coextensive therewith to preserve the wooden appearance of the major external surfaces of the member.

It is preferred that the recess or recesses in a wood member have an aggregate width less than about 30 percent of the width of the wood member. The reinforced structural member may have recesses in the wood member disposed at one end of the assembly with the recesses facing the next adjacent wood member and the wooden members being secured to each other by an appropriate adhesive, such as resorcinol or phenol-resorcinol based adhesive.

The composite member receiving recess is preferably of rectangular configuration with the longer sides of the rectangle being oriented generally perpendicular to the upper and lower surfaces of the wood member. It is generally preferred the composite members have a cross-sectional area less than about 5 percent and preferably about 0.2 to 1.5 percent of the cross-sectional area of the entire wooden structural member.

The method of the present invention includes providing a plurality of elongated wood members. The method in one embodiment involves providing one or more recesses in a first wooden member which recesses face an adjacent wooden member and positioning fiber reinforcing composite members within the recesses. The wooden members may then be adhesively secured to each other. The adjacent wooden member may be planar with the recesses in the first member receiving substantially the entire fiber reinforced composite member. Another alternative would be to provide aligned recesses facing each other in the two wood members with each having its own reinforcing member terminating at or near the wood surface. Also, non-aligned recesses may be provided in the adjacent wood members with a separate fiber reinforcing composite member in each recess abutting a planar portion of the other wooden member.

The method of making the composite member may include applying a force in a first direction at or adjacent to the transverse center and forces in an opposed second direction at or adjacent the lateral sides to open the recesses, inserting reinforced composites and withdrawing the forces to provide intimate engagement of the reinforced composites within the recesses.

In another embodiment of the method, the wooden member may be made from a plurality of strands or chips which are adhesively bonded and surround the fiber reinforced composite members, thereby creating the recesses with the formation of the structural member.

It is an object of the present invention to provide an improved reinforced wooden structural member wherein the structural member maintains a wooden appearance.

It is a further object of the present invention to make advantageous use of fiber reinforced composite inserts which are received within recesses formed in the interior of the structural member.

It is a further object of the present invention to provide such a reinforced wooden composite structural member which has increased strength over similarly sized wood structural members.

It is a further object of the present invention to provide such a structural member with a generally rectangular reinforcing member which has its longer sides oriented generally perpendicular to the upper wood member surface.

It is a further object of the present invention to provide a reinforced wooden composite structural member which is made from a plurality of wood strands, chips or other smaller particles which are adhesively bonded to fiber reinforced composite inserts.

It is a further object of the present invention to provide a method of making such a wooden structural member.

It is a further object of the present invention to insert the fiber reinforced composites within the recesses while the recesses are widened resiliently under influence of applied forces.

It is a further object of the present invention to provide such a system wherein fiber reinforced resin composites are adhesively secured within recesses in the wooden members and the assembly of wooden members is secured by suitable adhesive means.

It is a further object of this invention to provide such a system which enhances load bearing properties of the structural member.

These and other objects of the invention will be apparent from the following description of the preferred embodiments of the invention on reference to the drawings appended hereto.

DESCRIPTION OF THE PREFERRED EMBODIMENTS

The terms "wood" or "wooden" as employed herein includes, but is not limited to solid wood, a wooden member assembled from wooden sheets, veneers, strands, chips or other wood particles or components, as well as "engineered" or "manufactured" lumber.

As used herein, the term "fiber reinforced composite members" will refer to a plurality of elongated fibers disposed within an elongated resin matrix member and having at least a majority of the fibers extending along the length of the resin matrix member. It is preferred that the majority of such fibers be generally parallel to each other.

This invention may be used to provide structural beams, columns or other structural members. As used herein, the terms "beam" and "column" mean an elongated structural member having a thickness and width that are substantially less than the length thereof and the term "panel" means a structural member the thickness of which is substantially less than the width and length thereof.

Figure 1:
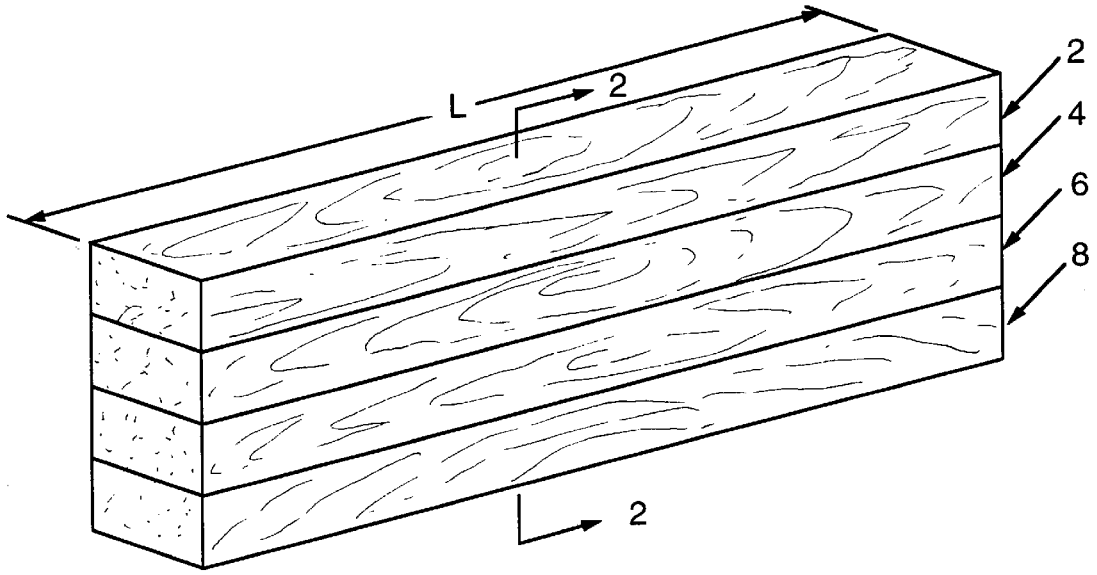
FIG. 1 is a perspective view of a reinforced structural composite wooden member of the present invention.
Figure 2:
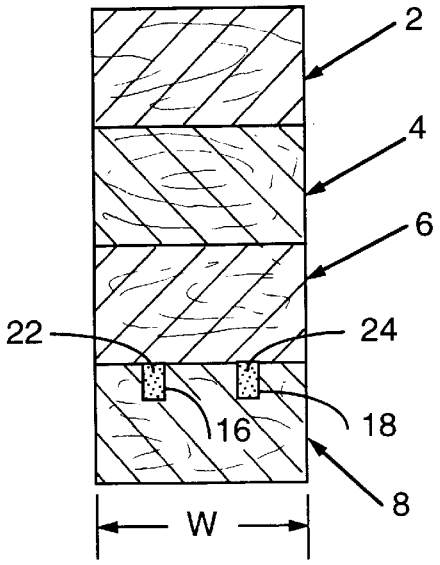
FIG. 2 is a cross-sectional illustration through 2—2of FIG. 1 showing an internal construction for the structural member.

Referring to FIGS. 1 and 2 there is shown a reinforced structural composite member which in the form shown has been shown of relatively short length L, but it will be appreciated that any length desired can be provided. A plurality of unitary elongated wooden members 2,4,6,8 are juxtaposed and the elongated members 2,4,6,8 are secured to each other by suitable means such as adhesive means to provide a structural composite member composed of wood. The individual wood members 2,4,6,8 are oriented generally parallel to each other and have generally aligned side and end surfaces. Wood member 8 has a pair of upwardly open recesses 16,18 with a pair of fiber reinforcing composite reinforcing members 22,24 which are intimately received therewithin and will be described in greater detail hereinafter. The fiber composite reinforcing members 22,24, disposed within the respective recesses 16,18 are secured therewithin as by adhesive means. The individual recesses 16,18 are preferably of substantially the same size. The individual wood members 2,4,6,8 are secured to each other by having suitable adhesive not shown disposed therebetween preferably in a substantially continuous manner such that the adhesive is substantially co-extensive with the abutting contacting faces of adjacent wood members 2,4,6,8. The fiber reinforced composite members 22,24 are oriented generally vertically with respect to the gluelines which secure wooden members 6, 8 to each other. While the invention is not limited as to a particular orientation, for convenience of reference herein, the orientation shown in FIG. 2 will be considered as having the fiber reinforced composite members 22,24 oriented generally perpendicular to the upper surface of the wooden member 8. In the preferred embodiment, the composite members 22,24 will depart from the vertical by less than about 5 degrees. In the form shown in FIG. 2, the recesses 16,18 are substantially rectangular and the fiber reinforced composites 22,24 which fit therein are generally rectangular and of the same height and width as each other and of slightly less width and equal or less height and of equal length to the recesses 16,18 and are in intimate force-fit contact therewith. It will be appreciated that in this manner a wooden reinforced member forms a unitary reinforced structure. As the recesses 16,18 have a total width less than the width W of the composite structural member and the composite fiber reinforced composite members 22,24 preferably have a length generally equal to the length L of wood members 2,4,6,8, the structural member is effectively reinforced while providing a wooden exterior which has a wood appearance over at least a major portion thereof. In the alternative, the reinforcing members may be of slightly lesser length than the wooden members.

It is preferred that the aggregate width of the recesses be less than about 30 percent of the width W of the wood members with less than about 20 percent being the preferred width. With reference once again to FIG. 2, it is also preferred that the reinforcing be provided in a wood member in the portion of the assembly which preferably is located in the portion stressed in tension in use, such as the bottom of a simply supported beam.

Referring to FIGS. 1 and 2, the fiber reinforced composite members will preferably be of complimentary shape to the recesses receiving them. In general it will be preferred for a rectangular shaped, fiber reinforced composite member to have a height which is about 2 to 8 times the width of the member. Such reinforcing members 22,24 may be produced by the known pultrusion process to produce a reinforcing member which is relatively flexible in a direction parallel to the width, but is very resistant to bending in the direction parallel to its height. In the form illustrated in FIG. 2, it will be appreciated that the fiber reinforced composite members 22,24 extend generally parallel to the longitudinal extent of the wood members 2,4,6,8 and are oriented generally perpendicular with respect to the plane of the gluelines or the plane of the upper surface of wood member 8. In this manner, the load carrying capacity of the structural member is increased without changing the external wooden appearance of the beam or the external dimensions thereof.

Among the preferred adhesives employed in gluing the wood members 2,4,6,8 to each other are resorcinol phenol-based adhesives, such as those commonly used in glu-lam constructions. It is also preferred to employ phenolic matrix resins and glass fibers in a phenolic resin matrix resin for the fiber reinforced composite reinforcing member.

In instances where it is not important to have the structural member have a completely wooden appearance from the exterior, the fiber reinforced composites may be co-extensive in length with the wooden members 2,4,6,8 if desired. An additional advantage of making the fiber reinforced composite of lesser length than the wood members 2,4,6,8 is that the bonds between the fiber reinforced composite members, such as 22,24 and the wood are not exposed to weathering. Also there is no path for entry of water into the interior of the structural member or other foreign matter.

Figure 3:
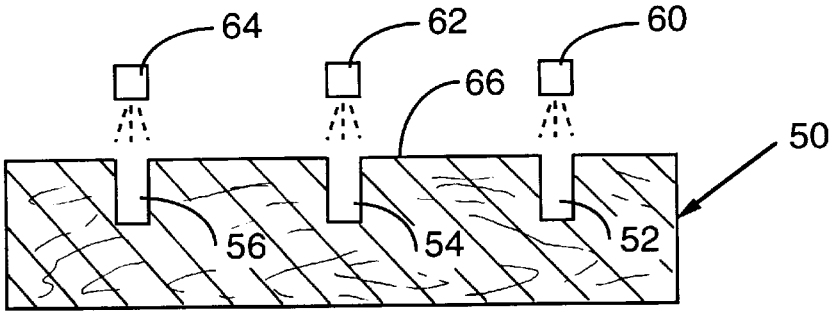
FIGS. 3 and 4 show in cross-section sequential stages of a preferred method of making the reinforced structural composite member.
Figure 4:
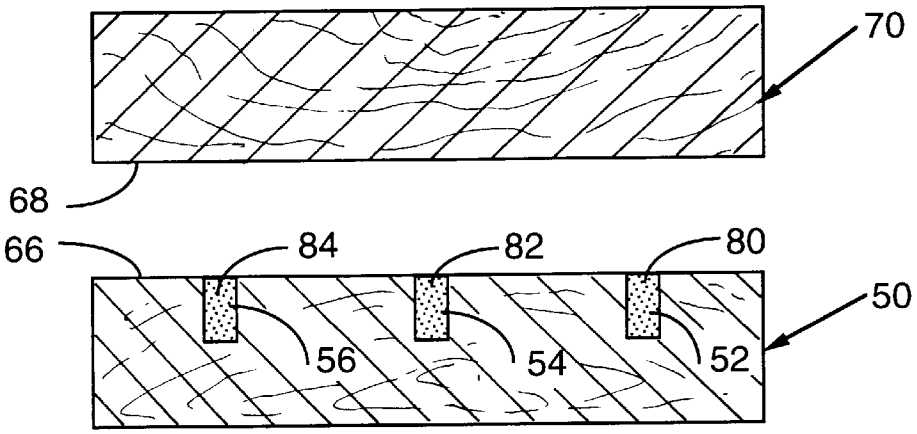

A preferred approach to making a composite structural member of the present invention, as shown in FIG. 3, is to provide a wooden member 50 which has one or more recesses 52,54,56 and introducing suitable adhesive into the recesses 52,54,56 as by spray nozzles 60,62,64, as well as onto one or both of the adjacent wood surfaces which will be bonded to an adjacent wood member such as surface 66. A plurality of fiber reinforced composite members 80,82,84 may be introduced into the recesses 52,54,56 of wooden member 50 with their upper ends generally coplanar with surface 66. Wooden member 70 may have surface 68 coated with adhesive and will be subjected to relative closing movement such that the fiber reinforced composite members 80,82,84 will be intimately force-fit received and adhesively retained in surface-to-surface contact in their respective recesses 52,54,56, respectively. The assembly is maintained under pressure until the adhesive sets. This may be done at elevated temperature or ambient conditions depending on the nature of the adhesive. In general, it will be preferred to provide adhesive on both the superposed wood members 50,70 and adhesively bond surfaces 66,68 simultaneously with establishing the composite shown in exploded form in FIG. 4. It will be appreciated that in lieu of adhesive bonding of the fiber reinforced composites within the recesses if desired, the composites may be secured therein by mechanical means either through friction fit or clamping action by the wood members 50,70 or by other mechanical means, such as through integrally created projections in the composite or by the configuration of the wood such as a dovetail configuration, for example.

Figure 5:
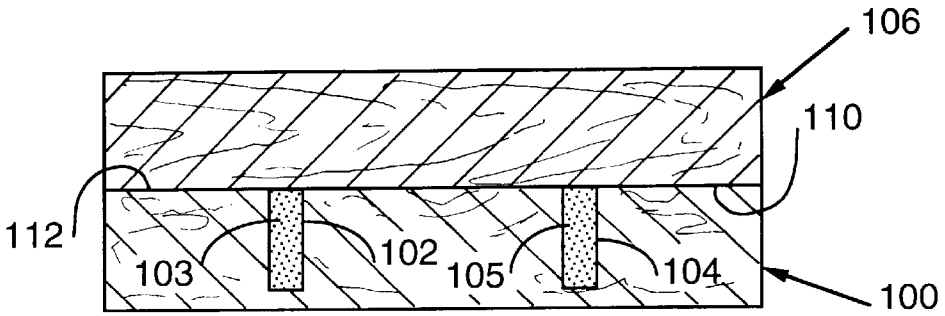
FIG. 5 is a cross-sectional illustration of a modified form of the invention wherein two recesses are provided in one of the two wooden members.

FIG. 5 illustrates a further embodiment of the invention wherein a first wooden member 100 has a pair of generally parallel recesses 102,104 which receive generally vertically oriented rectangular fiber reinforced composites 103,105, respectively. An elongated wood member 106 which has a generally planar lower surface 110 which is adhesively bonded to upper surface 112 of wood member 100 to thereby create reinforcement without requiring both facing wood members 100,106 to have recesses. This portion of the reinforced structural composite member is preferably located immediately adjacent the bottom ply of the assembly when under load. It is an area in tension. If desired, a similar structure having recesses in the upper surface of wooden member 106, with fiber reinforced members contained therein, could be employed.

In order to provide a greater understanding of the invention, examples will be considered. In these examples glass reinforcing fibers have been pultruded in a phenolic resin matrix. If desired, for purposes of the present invention, other synthetic, mineral or natural fibers may be embedded in any resin which is suitable for transferring energy from the fibers to the matrix such as for example, polyester, vinyl ester, or epoxy resins exhibiting sufficient longitudinal tensile and structural strength to provide adequate strength.

EXAMPLE 1

Two Douglas Fir boards were planed and prepared for bonding in a customary manner. Two generally rectangular grooves ¼ inch deep and ⅛ inch wide were cut in each board along the long axis of the board such that when the machined faces were placed together for bonding, the grooves would match. The grooves were generally vertically oriented. A commercially available resorcinol-modified phenolic adhesive, which contained about 7 to 50 percent by weight resorcinol, was employed. Penacolite® R-400 with H-30M hardener was applied to the faces at a spread of 70 pounds per 1000 square feet, which is a typical current commercial practice. A suitable alternate adhesive which could have been employed is G1131A with G1131B hardener as manufactured and sold by Indspec Chemical Corporation. Two generally rectangular composite bars produced by pultrusion from Resorciphen® 2074-A/2026-B resorcinol-modified phenolic resin and PPG 788 type E-Glass rovings were force-fit inserted into the grooves. The bars had a height of about ½ inch and a width of about ⅛ inch. The boards were assembled and clamped at a pressure of 125 psi for a cure schedule common for the adhesive. Curing for such adhesive typically employs temperatures in the range from about 70° F. to 85° F. for about 10 to 5.5 hours, double spreading, i.e., providing the adhesive on both the exterior surface of the reinforced composite member and the adjacent wood surfaces to be joined thereto and to adjacent wood surfaces is preferably employed or single spreading, i.e., applying to only one surface, may be employed is desired.

Samples were prepared from the glued boards by saw cutting identical-sized sections about 3½ inches in width 1⅜ inch thickness and 11¼ inch in length. These samples were tested using a 3-point bending test, with a span of 9 inches. Force was applied perpendicular to the thickness, (b) at a rate of ½ inch per minute.

The stress required to break the reinforced sample was 4450 psi compared to 4000 psi for the non-reinforced sample, indicating the composite bars did indeed reinforce the laminated boards effectively. A calculation comparing pounds of force needed to break the laminate indicated the percentage increase in breaking strength from the bars was slightly higher than the percentage increase from 2 plies of pultruded composite flat sheet in previous beam testing, as recited in co-pending U.S. patent application Ser. No. 08/380,858, filed Jan. 30, 1995, which is owned by the assignee of the present application, when related to volume fraction of composite added.

EXAMPLE 2

Douglas Fir boards, about 10 ft. by a nominal 1 inch by 3.5 inches, were prepared for bonding generally vertical, generally rectangular grooves about 3/16 inch wide by 9/16 inch deep were cut into one face of the wooden ply to be located immediately above the bottom ply of wood. Penacolite R-300 and H-30M hardener were mixed and applied to the faces of the boards to be bonded with a roller at a target spread of 70–80 pounds per 1000 square feet of glueline. Three composite bars produced by pultrusion from Resorciphen 2074-A/2026-B resorcinol-modified phenolic resin and PPG 788 type E-Glass rovings were force-fit inserted into the grooves. The bars had a height of about ½ inch and a width of about ⅛ inch. The boards were assembled and clamped at a pressure of 125 psi for a cure schedule common for the adhesive. Each beam contained 10 plies of board. The board containing the reinforcing bars was located in the ply immediately above the bottom ply, in the tension zone of the beam. The total percentage of reinforcement was about 0.7–0.8 percent of the cross-sectional area of the beam. Similar beams were made from identical lumber without adding reinforcing bars as a comparison.

The beams were permitted to cure at room temperature, as is the usual commercial practice with the adhesive, then tested in flexure by a 3 point bending method similar to ASTM D 198 at the APA—The Engineered Wood Association laboratories in Tacoma, Wash. The beams were supported at each end and a load was applied perpendicular to the gluelines using a calibrated hydraulic ram with two pivoting feet spaced at about equal distances from the midpoint of the beam. Deflection was measured using a linear potentiometer. Data collection was computerized. Results from five specimens of each type are shown in Table 1. An average improvement of about 21 percent on Modulus of Rupture (MOR) the ultimate bending strength was seen. The modulus of Elasticity (MOE), which is a measure of stiffness, was essentially unchanged and the test confirmed that the desired stiffness was preserved. The percentage improvement by our invention using less than 0.8 percent reinforcement is approximately equal to the percentage improvement in MOR seen in previous tests from adding FRP panels equal to 2.75 percent of the cross-sectional area to the beam, as cited in co-pending patent application Ser. No. 08/388,858. The results of these tests are shown in Table 1.

TABLE 1

| | Beam Results | | |
|---|---|---|---|
| Sample Number | Load lbf. | MOE psi × $10^6$ | MOR psi |
| | | | Control Beams |
| 1 | 13032 | 1.98 | 8454 |
| 2 | 9518 | 1.87 | 6168 |
| 3 | 12419 | 1.81 | 8705 |
| 4 | 12887 | 2.03 | 9146 |
| 5 | 13542 | 2.01 | 9612 |
| Average | 12280 | 1.94 | 8417 |
| | | | Reinforced Beams |
| 6 | 15486 | 1.84 | 10655 |
| 7 | 13734 | 1.82 | 9402 |
| 8 | 13364 | 1.86 | 9352 |
| 9 | 15744 | 2.02 | 10800 |
| 10 | 15226 | 1.85 | 10657 |
| Average | 14711 | 1.88 | 10173 |

It will be noted that while the modulus of elasticity was unchanged and thereby preserved the desired stiffness, the mean ultimate bending strength increased by an average of 21 percent.

It will be appreciated therefore that the present invention provides an effective means of increasing the flexural strength of wooden structural members made from a plurality of wood members by providing internal reinforcing means in the form of a fiber reinforced composite secured within one or more recesses in one or more of the wood members, preferably, adjacent the region of maximum tensile force. All of this is accomplished without requiring a change in the exterior of the structural wood member.

Figure 6:
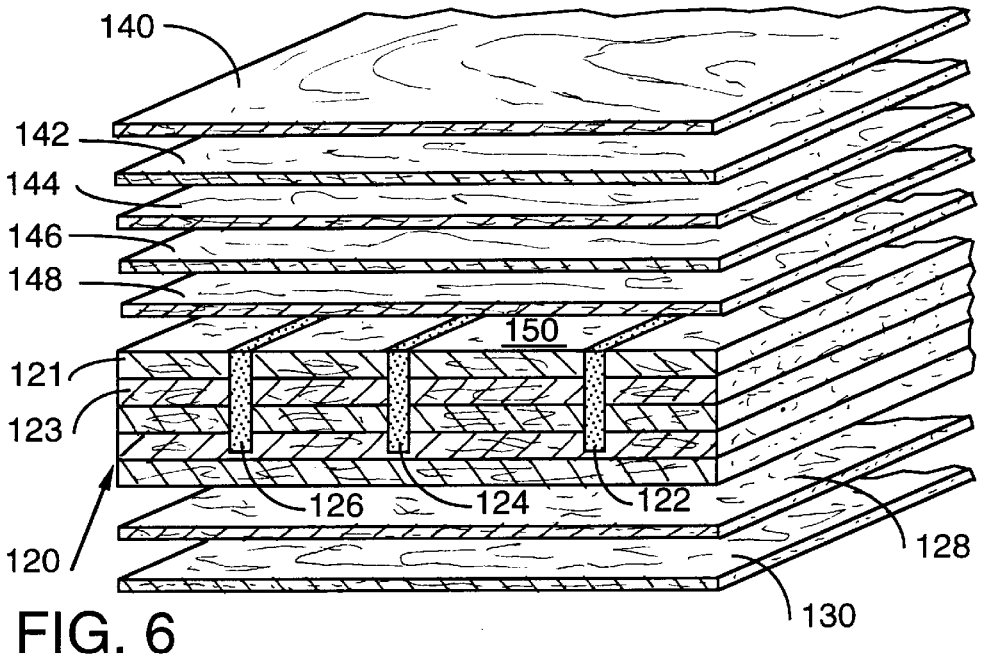
FIG. 6 illustrates schematically a step in a process of making a reinforced laminated veneer lumber reinforced structural composite member.

Referring to FIG. 6, which illustrates a step in the manufacture of laminated veneer lumber, a core portion 120 which, in the form shown, consists of a plurality of stacked, formed laminated plies of veneer, slotted to receive fiber generally rectangular reinforced composite members. Plies 121,123, are adhesively secured to each other and have generally rectangular fiber reinforced composite members 122,124,126 generally vertically oriented and received within upwardly open slots formed within core 120. If desired, one or more plies of wood veneer, such as 128,130, may be adhesively secured to the undersurface of core 120 as by conventional gluing methods. In addition, overlying spaced wood veneer pieces 140,142,144,146,148 are adhesively secured to each other and to the upper surface 150 of core 120.

Figure 7:
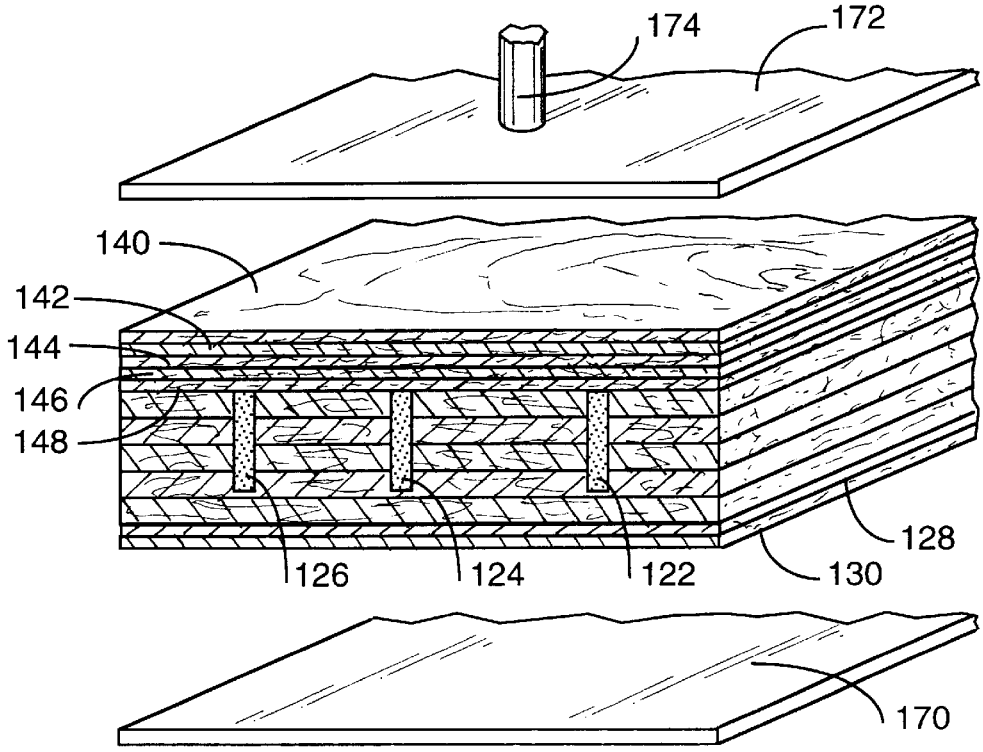
FIG. 7 illustrates a reinforced structural composite member of the type made by the process of FIG. 6.

As shown in FIG. 7, the upper and lower extremities of the fiber reinforced composite members are protectively surrounded and not exposed through the upper and lower plies 140,130 of the structural member. The fiber reinforced composite members 122,124,126 may be of the same longitudinal extent as the laminated veneer lumber.

The composite wooden structure shown in FIGS. 6 and 7 will have greater width and length than thickness.

While FIGS. 1 through 5 show a structural member more in the nature of a composite beam, the laminated veneer lumber of FIG. 6 and 7 may be in the form of a beam or may be provided in larger elements, such as 4'×8' ft. sheets, for example, if desired.

Figure 8:
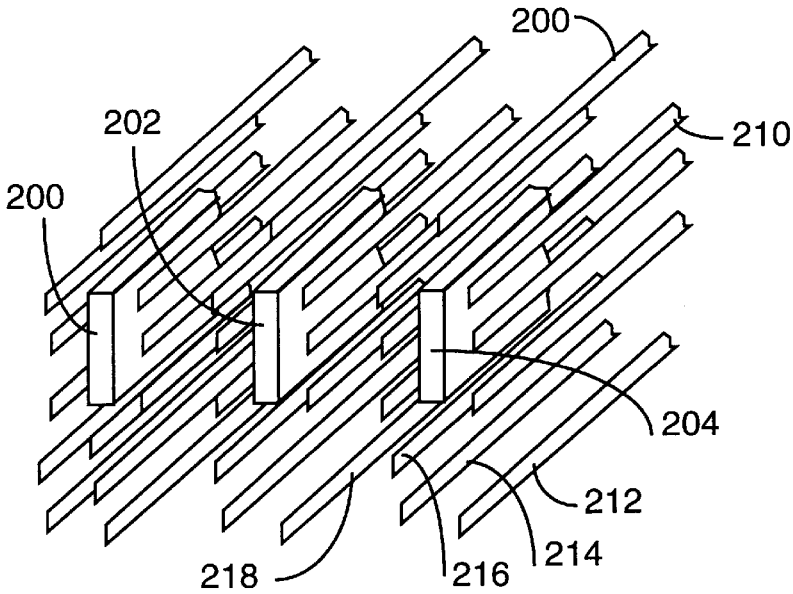
FIG. 8 illustrates schematically a step in the process of making a reinforced structural composite member made from parallel wood strands.
Figure 9:
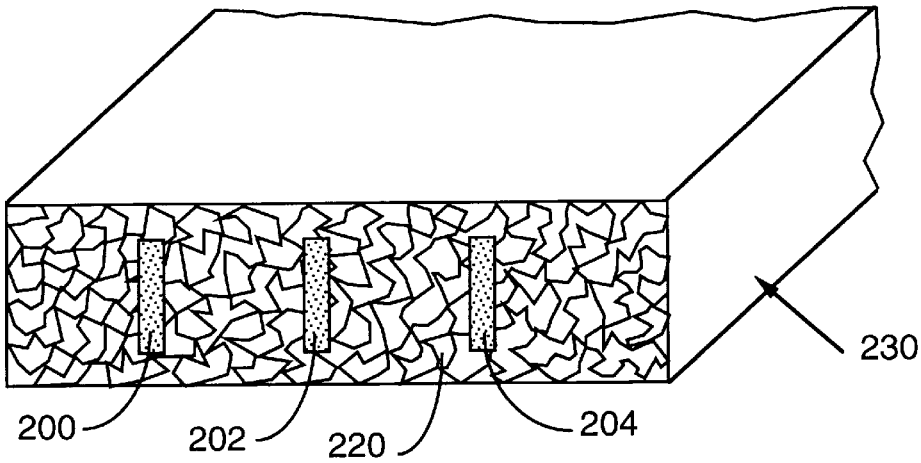
FIG. 9 illustrates a reinforced structural composite member of the type made by the process of FIG. 8.

Referring to FIGS. 8 and 9, there is shown, respectively, a step in the process of making parallel strand lumber which is a type of engineered lumber or manufactured lumber and a final product. In this embodiment, a plurality of preferably generally rectangular, generally vertically oriented fiber reinforced composite members 200,202,204 are positioned within a plurality of elongated wood strands which are preferably wetted with a suitable adhesive.

By application of suitable pressure at the desired adhesive curing temperature which may be on the order of about 220° F. to 320° F., the structural member of FIG. 9 is created. In this embodiment, it will be appreciated that while the elongated fiber reinforced composite elements 200,202,204 are disposed within generally vertically oriented recesses in the final product 230, wherein these fiber reinforced members 202,204 are surrounded by the adhesively secured parallel wood strands 220, in this embodiment, the recesses are not preformed as in other embodiments of the invention. In lieu of the use of wood strands, wood chips, which have surfaces wetted with appropriate adhesives, may be employed.

In general, it will be preferred to create the products of FIGS. 7 and 9 through the application of suitable pressure and temperature in order to provide effective curing of the adhesives, which adhesives may be conventional in nature.

As is true with respect to other embodiments of the invention, it will be preferred to have the recesses within which the fiber reinforced composite articles are disposed of an aggregate lesser width than the width of the wooden members within which they are contained.

In creating the composites shown in FIGS. 7 and 9, any conventional means of applying the desired combination of pressure and temperature may be employed to create a solid, intimately bonded structural member. As shown schematically in exploded form in FIG. 7, a lower platen member 170 is adapted to receive the fiber reinforced composite members 122,124,126 and the wood members. An overlying press platen 172 is connected to the remaining portions of the press by connecting rod 174. It will be appreciated that downward movement of the platen 172 will apply compressive force to the materials disposed on platen 170. Suitable heat may be applied through the use of heated platens, such as by electrical or steam heat. Appropriate jigs well known to those skilled in the art may be employed to position the fiber reinforced composite members during manufacture.

Figure 10:
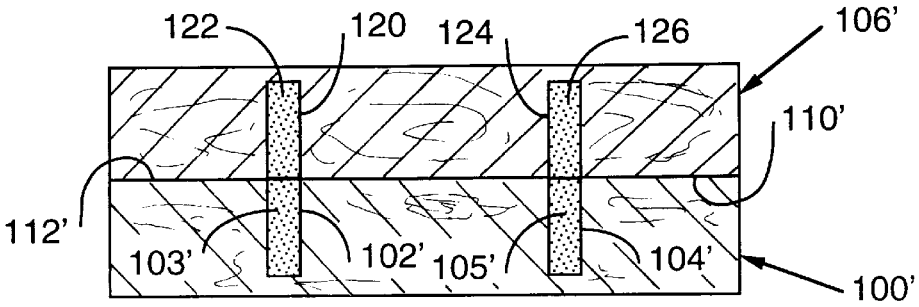
FIG. 10 is a cross-sectional illustration generally similar to FIG. 5, but showing aligned recesses in the upper wood member.

FIG. 10 is an embodiment somewhat similar to that shown in FIG. 5 with common features having a prime adjacent the reference number shown in FIG. 10. In FIG. 10, in addition to the generally vertically oriented fiber reinforced composite members 103' and 105' in wood member 100', upper wooden member 106' has a pair of downwardly open, generally vertically oriented recesses 120,124 aligned respectively with recesses 102', 104'. Generally rectangular, generally vertically oriented fiber reinforced composite members 122,126 are force-fit into and respectively, adhesively secured in recesses 120,124. Recesses 120,124 are preferably of substantially the same size and shape as recesses 102', 104'. This embodiment provides added reinforcement while maximizing the area of the abutting wood surfaces 110', 112' which are adhesively bonded to each other.

While positioning the reinforcing member in the tension zone of a beam improves the load bearing capacity, in some instances, it may be desired to improve the stiffness of the beam by placing reinforcement in the compression zone of the beam.

It will also be appreciated that the present invention provides the benefits described herein without requiring pre-stressing of the fiber reinforcements with respect to the structural member. Also, resins other than phenolics and fiber reinforcements other than glass, such as carbon, synthetic or organic fibers may be employed, if desired.

Words of orientation, such as "upper," "lower," or "vertical," for example, are employed solely to establish relative relationships for clarity of disclosure and are not to be interpreted as limitations on the invention.

While the particular application will to a great extent be determined by the particular end use application, in general, it will be preferred to have the fiber reinforced composite members have a cross-sectional area of less than about 5 percent of the cross-sectional area of the structural member and most preferably about 0.2 to 1.5 percent of the structural member cross-sectional area.

Figure 11:
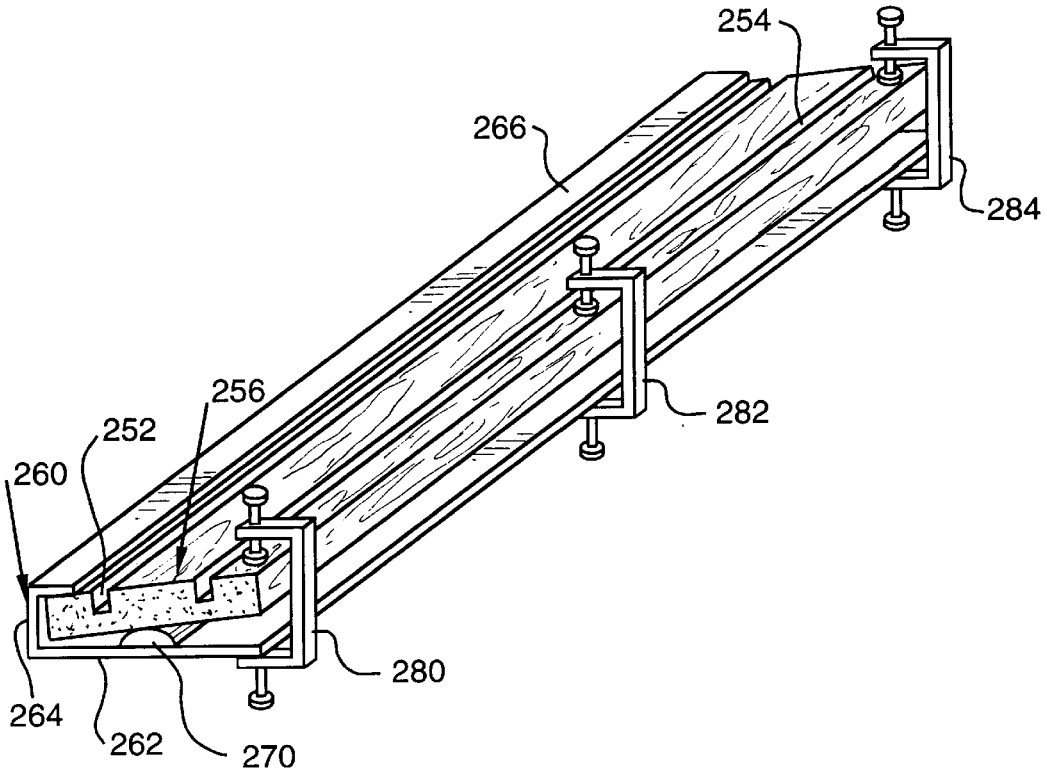
FIG. 11 is a perspective view of a form of clamping system employable in making a reinforced structural composite member.
Figure 12:
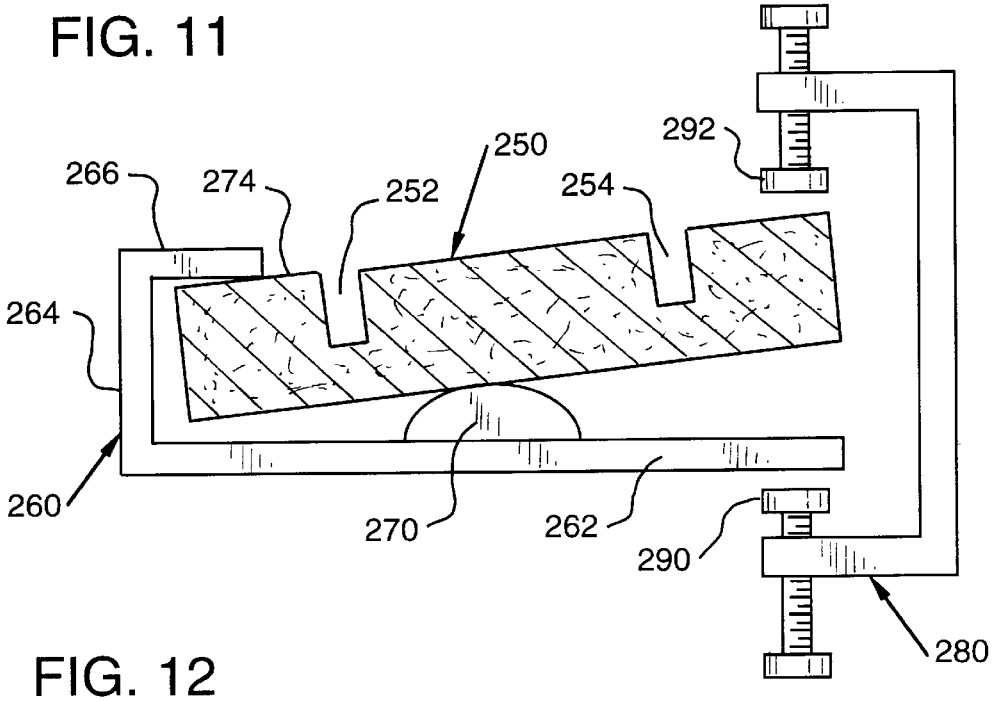
FIG. 12 is a cross-sectional view of the clamping system of FIG. 11 before insertion of the reinforcing means.

A preferred method and apparatus for inserting the fiber reinforced composite members into the recesses, is shown in FIGS. 11 and 12. An elongated wooden member 250 has a pair of elongated generally parallel recesses 252,254. An elongated generally L-shaped frame 260 has a base 262, a generally perpendicular leg 264 and a reentrant flange 266. An upwardly projecting lobe 270 extends upwardly from the base 262. The reentrant flange 266 and lobe 270 are elongated and preferably at least as long as the wood member 250. The lobe 270 is disposed generally centrally on the base 262. The reentrant flange 266 engages the upper surface 274 laterally outwardly of recess 252. A plurality of wood clamps 280,282,284 are longitudinally spaced from each other and each have a pair of adjustable clamping elements, such as 290,292, on clamp 280. Clamp 292 engages the upper surface 274 of wooden member 250 laterally outwardly of recess 254. In the stage shown in FIG. 12, the recesses 252,254 have their normal width as no force is being applied to wooden member 250.

Figure 13:
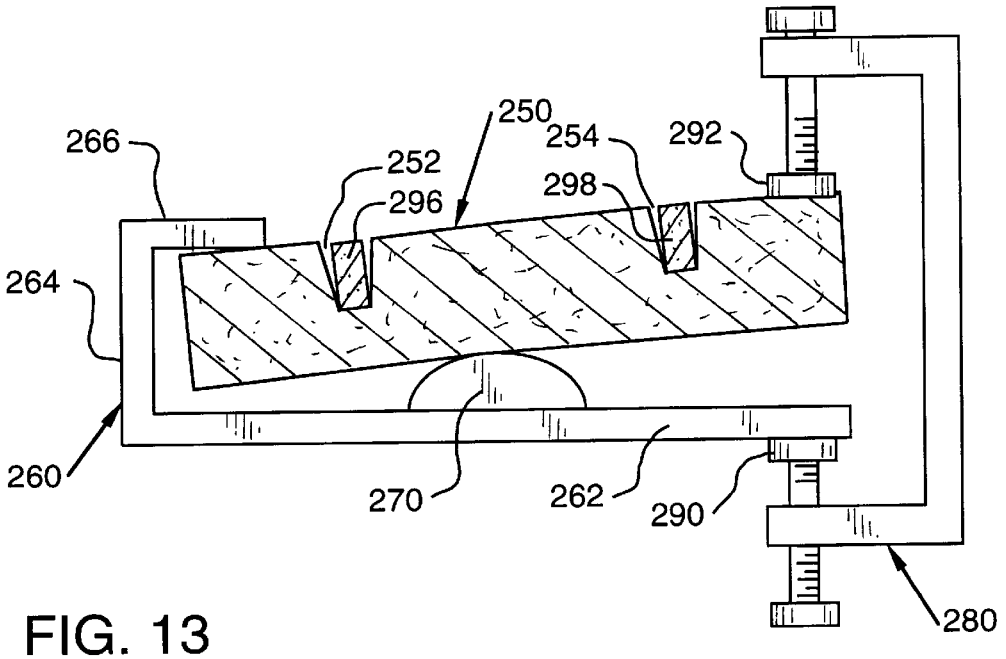
FIG. 13 is a cross-sectional view similar to FIG. 12 showing the reinforcing members being inserted.

Referring to FIG. 13, clamp 280 has been closed to apply forces to wooden member 250 by element 292, lobe 270 and reentrant flange 266. This causes the upper portions of recesses 252,254 to open resiliently and facilitate easy insertion of elongated fiber reinforced composite members 298 into recesses 252,254.

Figure 14:
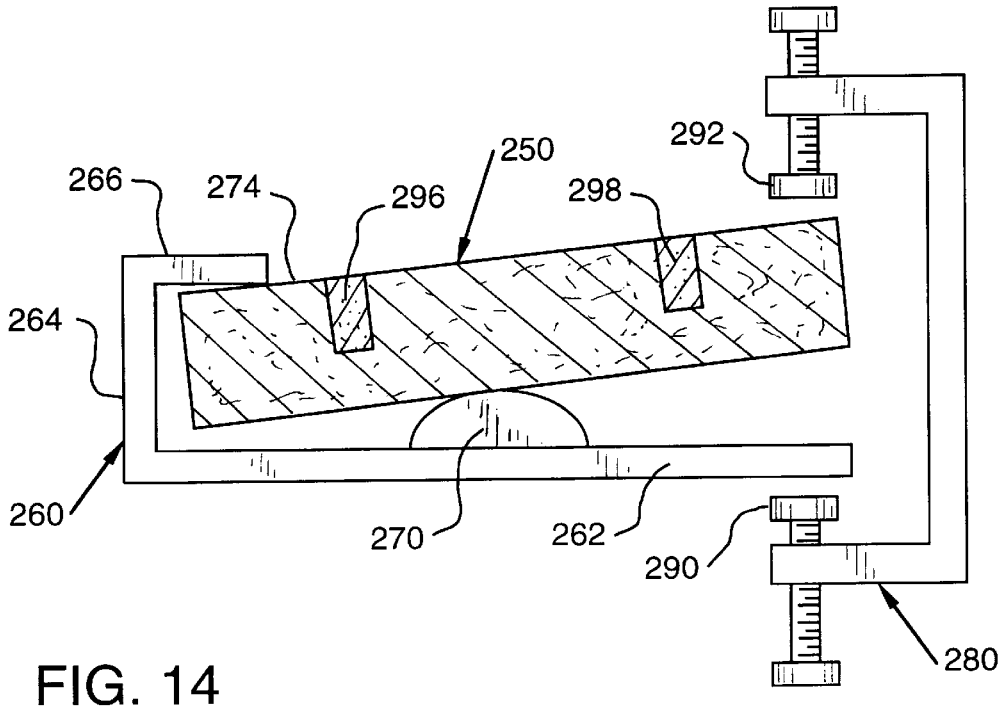
FIG. 14 is a cross-sectional view similar to FIG. 12 but showing the reinforcing members in place after insertion.

After completion of insertion of fiber reinforced composite members, as shown in FIG. 14, the clamp 280 is opened to remove the forces applied to the wooden member 250 to permit the recesses 252,254 to close in intimate securing contact with the composite members 298, respectively, and thereby retain them in the desired position. If desired, more or less than two recesses may be employed.

The L-shaped element 260 may be made of any suitable material, such as metal or rigid plastic, for example.

Whereas particular embodiments of the present invention have been described herein for purposes of illustration, it will be appreciated by those skilled in the art that numerous variations of the details may be made without departing from the invention as described in the appended claims.

We claim:

1. A reinforced wooden structural composite member comprising:

a plurality of adhesively joined wood members each having generally rectangular cross-section with an upper surface, at least one elongated recess in a first said wood member facing another said wood member, said recess being generally rectangular in cross section and having a height about 2 to 8 times its width, and an elongated fiber reinforced composite member having a shape complementary to said recess disposed within said recess and secured therein by adhesive, and said fiber reinforced composite member having its longer sides oriented generally perpendicular to said upper surface.

2. The reinforced structural composite member of claim 1 including said fiber reinforced composite member having a width substantially less than the width of said structural member.

3. The reinforced structural composite member of claim 2 which includes a plurality of said at least one elongated recess and a said fiber reinforced composite member secured within each said recess by adhesive means selected from the group consisting of resorcinol and phenol resorcinol-based adhesives.

4. The reinforced structural composite member of claim 2 including a second said wood member having a plurality of said recesses and being secured to said first wood member, and said second wood member having said plurality of recesses generally aligned with said first wood member recesses and each pair of said aligned recesses receiving at least one fiber reinforced composite member therein.

5. The reinforced structural composite member of claim 2 including said recesses in said first wood member having an aggregate width of less than about 30 percent of the width of said wood member.

6. The reinforced structural composite member of claim 5 including said fiber reinforced composite member having a cross-sectional area which is less than about 5 percent of the cross-sectional area of the entire wooden structural member.

7. The reinforced structural composite member of claim 5 including said fiber reinforced composite members comprise pultruded phenolic glass reinforcing bars.

8. The reinforced structural composite member of claim 2 including said fiber reinforced composite members being force-fit into said recesses.

9. The reinforced structural composite member of claim 1 including a second said wood member having a generally planar surface in contact with said fiber reinforced composite member and contacting said first wood member at a surface adjacent to said second wood member.

10. The reinforced structural composite member of claim 1 including said fiber reinforced composite members not being prestressed.

11. The reinforced structural composite member of claim 1 including said first wood member being disposed in the portion of said structural member which will be placed in tension under load.

12. The reinforced structural composite member of claim 1 including said fiber reinforced composite members having a cross-sectional area less than about 0.2 to 1.5 percent of the cross-sectional area of said structural member.

13. The reinforced structural composite member of claim 1 including said fiber reinforced composite members extending continuously along the full longitudinal extent of said wood members.

14. The reinforced structural composite member of claim 1 including said structural member being a panel having greater width than height and greater length than height.

15. The reinforced structural composite member of claim 14 including said composite structural member having glass reinforced fibers disposed within a phenolic resin matrix.

16. The reinforced structural composite member of claim 1 including said structural member being a beam.

17. The reinforced structural composite member of claim 1 including said structural member is formed in part from a plurality of adhesively bonded pieces of wood.

18. The reinforced structural composite member of claim 17 including said pieces of wood being wood chips.

19. The reinforced structural composite member of claim 1 including said structural member being an engineered wood product.

20. The reinforced structural composite member of claim 1 including said rectangular fiber reinforced composite member being no more than 5 degrees off being perpendicular to said upper surface.

21. A method of creating reinforced structural composite member comprising providing a plurality of wood members selected from the group consisting of wood chips, wood veneers, wood strands, wood particles and combinations thereof, applying adhesive selected from the group consisting of resorcinol and phenol resorcinol-based adhesives to said wood members, providing at least one generally rectangular elongated fiber reinforced composite member having a height about 2 to 8 times its width, positioning said fiber reinforced composite member within said wood members with said fiber reinforced composite member comprising less than about 5 percent of the total cross section of said wood members and said fiber reinforced composite member, and under the influence of pressure and temperature curing said adhesive to create a reinforced structural member having an upper surface with the longer sides of said rectangular fiber reinforced composite member being oriented generally perpendicular to said upper surface.

22. The method of claim 21 including providing a plurality of said fiber reinforced composite members with an aggregate width less than the width of said structural member.

23. The method of claim 22 including providing said fiber reinforced composite members as pultruded phenolic glass reinforcing bars.

24. The method of claim 22 including creating said structural member with said composite members having a cross-sectional area less than about 0.2 to 1.5 of the cross-sectional area of said structural member.

25. The method of claim 21 including employing a plurality of said fiber reinforced composite members, and positioning said composite members in generally parallel relationship to each other.

26. A reinforced structural member comprising:

a plurality of wood members adhesively joined together into a generally rectangular cross-section, a plurality of elongated recesses in a first said wood member, each said recess being generally rectangular in cross section and having a height about 2 to 8 times its width, and a pultruded phenolic glass reinforcing bar disposed in each said recess, each said bar having a cross-sectional shape complementary to its recess and secured therein by adhesive selected from the group consisting of resorcinol and phenol resorcinol-based adhesives, said reinforcing bars having an aggregate cross-sectional area less than about 5 percent of the cross-sectional area of said reinforced structural member.

27. A reinforced structural member as set forth in claim 26 in which said plurality of wood members each has a generally rectangular cross-section and an upper surface, and said recesses are in the upper surface of at least one of said members.

* * * * *